US011172759B2

(12) United States Patent
Liu

(10) Patent No.: US 11,172,759 B2
(45) Date of Patent: Nov. 16, 2021

(54) DIAMOND-SHAPED FOLDING RACK

(71) Applicant: GUANGDONG WIREKING HOUSEWARES & HARDWARE CO.,LTD, Foshan (CN)

(72) Inventor: Nengwen Liu, Foshan (CN)

(73) Assignee: GUANGDONG WIREKING HOUSEWARES & HARDWARE CO., LTD, Foshan (CN)

( * ) Notice: Subject to any disclaimer, the term of this patent is extended or adjusted under 35 U.S.C. 154(b) by 0 days.

(21) Appl. No.: 17/017,720

(22) Filed: Sep. 11, 2020

(65) Prior Publication Data

US 2020/0405050 A1 Dec. 31, 2020

(30) Foreign Application Priority Data

Jul. 13, 2020 (CN) ..... 202021373487.5

(51) Int. Cl.
*A47B 43/00* (2006.01)
*A47B 96/14* (2006.01)
*A47F 5/10* (2006.01)

(52) U.S. Cl.
CPC ..... *A47B 43/00* (2013.01); *A47B 96/14* (2013.01); *A47F 5/10* (2013.01)

(58) Field of Classification Search
CPC ..... A47B 43/00; A47B 96/14; A47B 83/0213; A47B 47/027; A47B 47/028; A47B 47/0083; A47B 47/02; A47B 47/021; A47F 5/108; D06F 57/08; B62B 3/02; B62B 3/002
USPC ..... 211/200, 201, 149; 108/166–168, 108/170–173, 175, 115, 162
See application file for complete search history.

(56) References Cited

U.S. PATENT DOCUMENTS 1,304,847 A * 5/1919 Blais et al. ..... A47F 5/13 108/163
1,408,604 A * 3/1922 Kawa ..... G03D 15/027 108/177
RE18,807 E * 4/1933 Kirk ..... A47B 43/00 248/163.1
2,249,234 A * 7/1941 Srodulski ..... G07F 9/10 312/42
2,469,911 A * 5/1949 Applegate ..... A47G 25/0664 211/201
2,584,489 A * 2/1952 Morrison ..... A47F 5/108 211/149
2,596,986 A * 5/1952 Curtis ..... A61G 13/105 280/641
3,093,247 A * 6/1963 Erickson ..... A47B 31/04 108/188
4,202,278 A * 5/1980 Wadenhed ..... B62B 3/006 108/102
4,339,141 A * 7/1982 Thiboutot ..... B62B 1/12 280/42

(Continued)

*Primary Examiner* — Jennifer E. Novosad

(57) ABSTRACT

A diamond-shaped folding rack includes a left side frame, a right side frame, a folding layer plate, a linkage vertical rod, and a locking mechanism. The folding layer plate is axially connected to the left and right side frames. The linkage vertical rod is provided at a folding junction of the folding layer plate. The linkage vertical rod moves up to allow the folding layer plate to fold upward; the linkage vertical rod moves down to allow the folding layer plate to unfold downward and horizontally.

9 Claims, 9 Drawing Sheets

(56) References Cited

U.S. PATENT DOCUMENTS 4,740,010 A * 4/1988 Moskovitz ..... A47B 31/04 108/170
5,131,547 A * 7/1992 Goldberg ..... A47F 5/13 108/166
5,806,864 A * 9/1998 Zielinski ..... B62B 3/02 280/42
6,123,207 A * 9/2000 Mast ..... A47B 43/00 211/149
6,349,962 B1 * 2/2002 Johanson ..... B62B 3/02 280/42
8,011,686 B2 * 9/2011 Chen ..... B62B 3/106 280/651
8,256,629 B2 * 9/2012 Zhu ..... A47B 43/00 211/149
8,672,147 B2 * 3/2014 Lam ..... A47F 7/18 211/149
9,079,597 B2 * 7/2015 Gonzalez ..... A47B 43/00
9,474,368 B2 * 10/2016 Frankel ..... A47F 5/10
9,913,533 B1 * 3/2018 Ke ..... A47B 96/021
10,058,171 B2 * 8/2018 Deng ..... A47B 96/021
10,292,491 B1 * 5/2019 Ke ..... A47F 5/137
2002/0023889 A1 * 2/2002 Larbaletier ..... A47F 5/12 211/150
2002/0109441 A1 * 8/2002 Wang ..... A47B 43/00 312/258
2004/0226491 A1 * 11/2004 Chen ..... A47B 3/002 108/124
2006/0226101 A1 * 10/2006 Liang ..... A47B 43/00 211/149
2007/0251907 A1 * 11/2007 Li ..... A47B 3/087 211/195
2011/0155680 A1 * 6/2011 Pong ..... A47B 31/04 211/199
2011/0253660 A1 * 10/2011 Pong ..... A47B 31/04 211/198
2020/0405050 A1 * 12/2020 Liu ..... A47B 43/00

* cited by examiner

DIAMOND-SHAPED FOLDING RACK

TECHNICAL FIELD

The present disclosure relates to the technical field of racks, in particular to a diamond-shaped folding rack.

BACKGROUND

At present, the Chinese Patent CN201520048757.8 provides a four-layer folding rack with a stable structure for instantaneous retraction, comprising a rack body, a folding net and a top net on the rack body; wherein the rack body from a frame formed by four main frames; a vertical support rod provided between two main frames and parallel to a support, which is configured to support the folding net; the top net is located on the top layer of the rack body, the folding net is located on the middle and lower layer of the rack body, and there are three layers of folding nets, which are folded with the central axis as the center of symmetry, and the entire rack body is provided with four layers of carrying nets in which objects are placed. The vertical support rod is supported between the three layers of the folding nets, the top of the vertical support rod is movably connected with two side support rods through a slider, and the bottoms of the two side support rods are fixedly connected to the main frame, respectively, thereby assisting the vertical support rod further improving the support strength of the folding net; the folding rack with a stable structure has the advantages of strong storage capacity, being used without assembly, finishing retraction and folding instantaneously, and taking up very little space.

However, the folding rack of the above structure has the following shortcomings: the vertical support rod is supported between three layers of the folding nets, and only serves as a support, so that when the folding rack is folded or unfolded, the two side support rods can only be driven by the slider alone to fold toward the center of symmetry or unfold outward, which is difficult to realize synchronous folding or unfolding of the multi-layer folding rack, complicated to operate and poor in structural stability.

SUMMARY

In order to overcome the shortcomings of the prior art, the object of the present disclosure is to provide a diamond-shaped folding rack. The folding rack adopts the structural cooperation of the linkage vertical rod and the locking mechanism, which greatly improves the support strength and effectively realizes the anti-falling effect. The locking stability is strong, and the linkage lock mechanism is folded inward or unfolded outward while the linkage vertical rod moves up or down, so that the multi-layer folding layer plates folded inward or unfolded outward synchronously, it is convenient to operate, and the operation is smooth and stable.

The object of the present disclosure is achieved by the following technical solutions: a diamond-shaped folding rack, comprises a left side frame, a right side frame, a folding layer plate, a linkage vertical rod, and a locking mechanism; wherein the left and right ends of the folding layer plate are axially connected to the left and right side frames: the linkage vertical rod is provided at the folding junction of the folding layer plate, the linkage vertical rod moves up to allow the folding layer plate to fold upward; the linkage vertical rod moves down to allow the folding layer plate to unfold downward and horizontally; the locking mechanism comprises a upper left link, a lower left link, a left support rod, an upper right link, a lower right link, and a right support rod; the left support rod, the lower left link, the lower right link, and the right support rod are connected end to end to form a diamond-shaped extendable frame; one end of the upper left link is hinged to the left junction of the diamond-shaped extendable frame, and the other end thereof is hinged to the left frame; one end of the upper right link is hinged to the right junction of the diamond-shaped extendable frame, and the other end thereof is hinged to the right frame; the linkage vertical rod is provided with an elongated slot, the upper junction of the diamond-shaped extendable frame slides up and down on the linkage vertical rod along the length of the elongated slot, and the lower junction of the diamond-shaped extendable frame is positioned at the bottom of the linkage vertical rod; and when the diamond-shaped extendable frame is pressed down, the left support rod and the right support rod control the upper left link, the lower left link, the upper right link and the lower right link to move to a fold position to lock the folding rack.

Further, the upper junction of the diamond-shaped extendable frame is provided with a handle buckle, the side of the handle buckle is provided with a protruding tongue, and the protruding tongue slides up and down along the length of the elongated slot on the linkage vertical rod.

Further, the folding layer plate comprises a left layer plate and a right layer plate. A first connector is disposed on one side of the left layer plate opposite to the right layer olate. A second connector is disposed on one side of the right layer plate opposite to the left layer plate. The first connector matches the second connector. The first connector and the second connector are connected by a pin; and when the folding layer plate is unfolded, the first connector abuts on the second connector, so that the left layer plate and the right layer plate are in a horizontal position.

Further, the linkage vertical rod is installed at the folding junction of the folding layer plate through the pin.

Further, the top of the left side frame and the top of the right side frame are provided with an inverse layer plate.

Further, one side of the inverse layer plate is hinged on the left side frame, and the other side thereof is fixed on the right side frame by a lock fastener.

Further, the lock fastener comprises a pinball provided on the right side frame and a locking sheet provided on one side of the inverse layer plate, the locking sheet is provided with an opening, and the pinball extends into the opening of the locking sheet to fix the inverse layer plate on the top of the right side frame.

Further, a U-shaped elastic sheet is connected to the pinball.

Further, the bottom of the left side frame and the bottom of the right side frame are provided with a roller.

Compared with the prior art, the beneficial effects of the present disclosure are as follows The folding rack adopts the structural cooperation of the linkage vertical rod and the locking mechanism, which greatly improves the support strength and effectively realizes the anti-falling effect. The locking stability is strong, and the linkage lock mechanism is folded inward or unfolded outward while the linkage vertical rod moves up or down, so that the multi-layer folding layer plates folded inward or unfolded outward synchronously, it is convenient to operate, and the operation is smooth and stable.

At the same time, the present application presses down the diamond-shaped extendable frame to fully unfold the locking mechanism outward. At this time, the left support rod straightens the upper left link and the lower left link, so that the left frame, the bottom folding layer plate and the connecting line between the upper left link and the lower left link encircle a stable triangle structure; synchronously, the right support rod straightens the upper right link and the lower right link, so that the right frame, the bottom folding layer plate and the connecting line between the upper right link and the lower right link encircle a stable triangle structure, which completely locks the entire folding rack. In addition, there are load-bearing objects on the rack to achieve the purpose of locking. Within a certain load-bearing range, the greater the weight of the load-bearing object, the better the locking effect.

Figure 1:
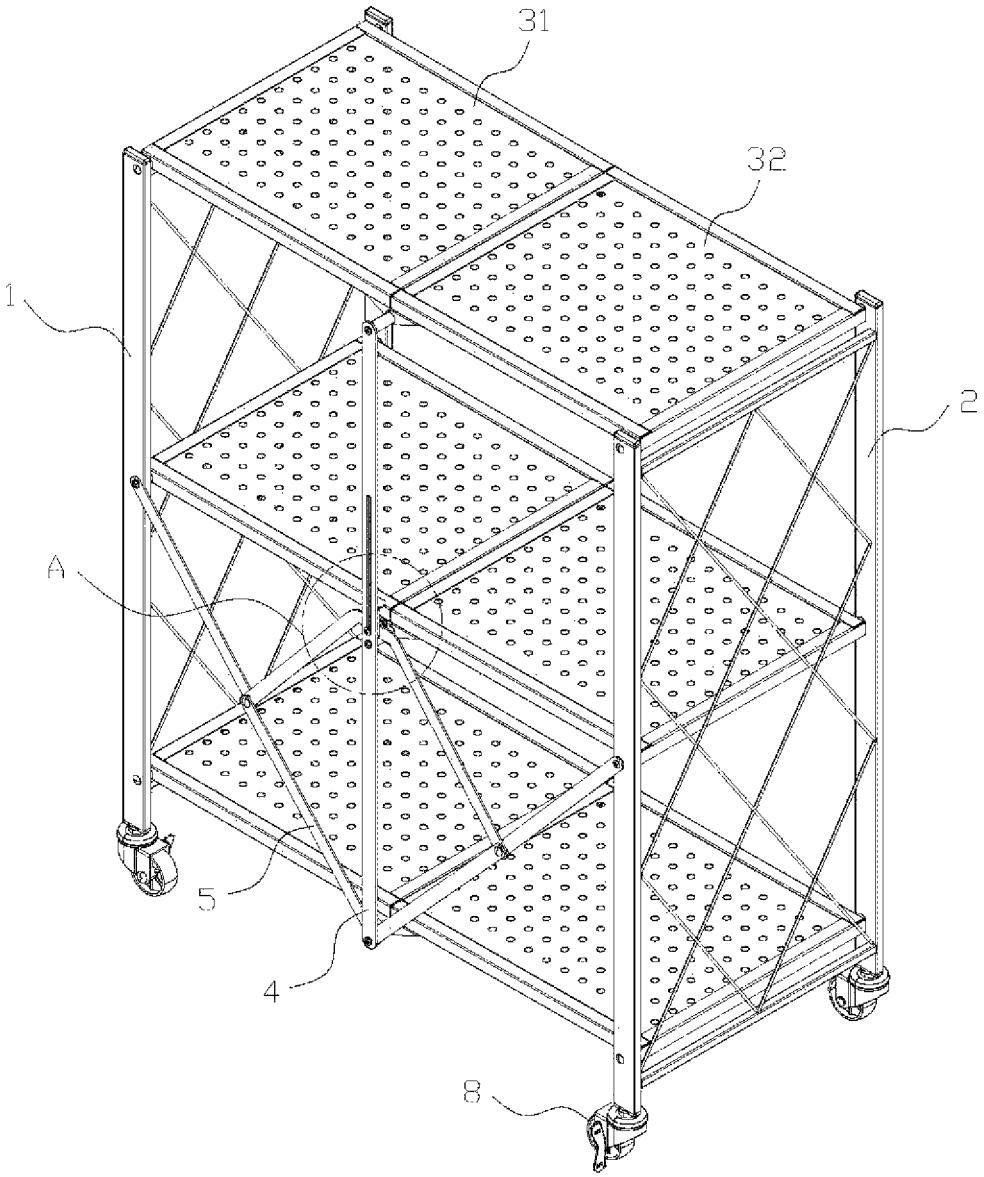
FIG. 1 is a schematic structural diagram of a three-layer diamond-shaped folding rack according to the preferred embodiment 1 of the present disclosure
Figure 2:
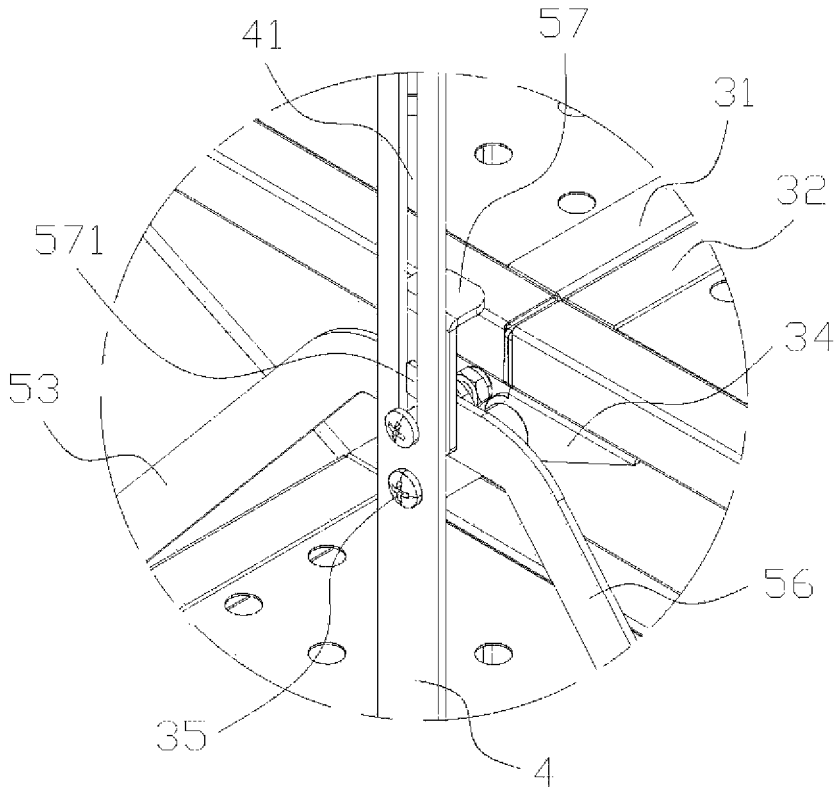
FIG. 2 is a schematic diagram of an enlarged structure of area A in FIG. 1.
Figure 3:
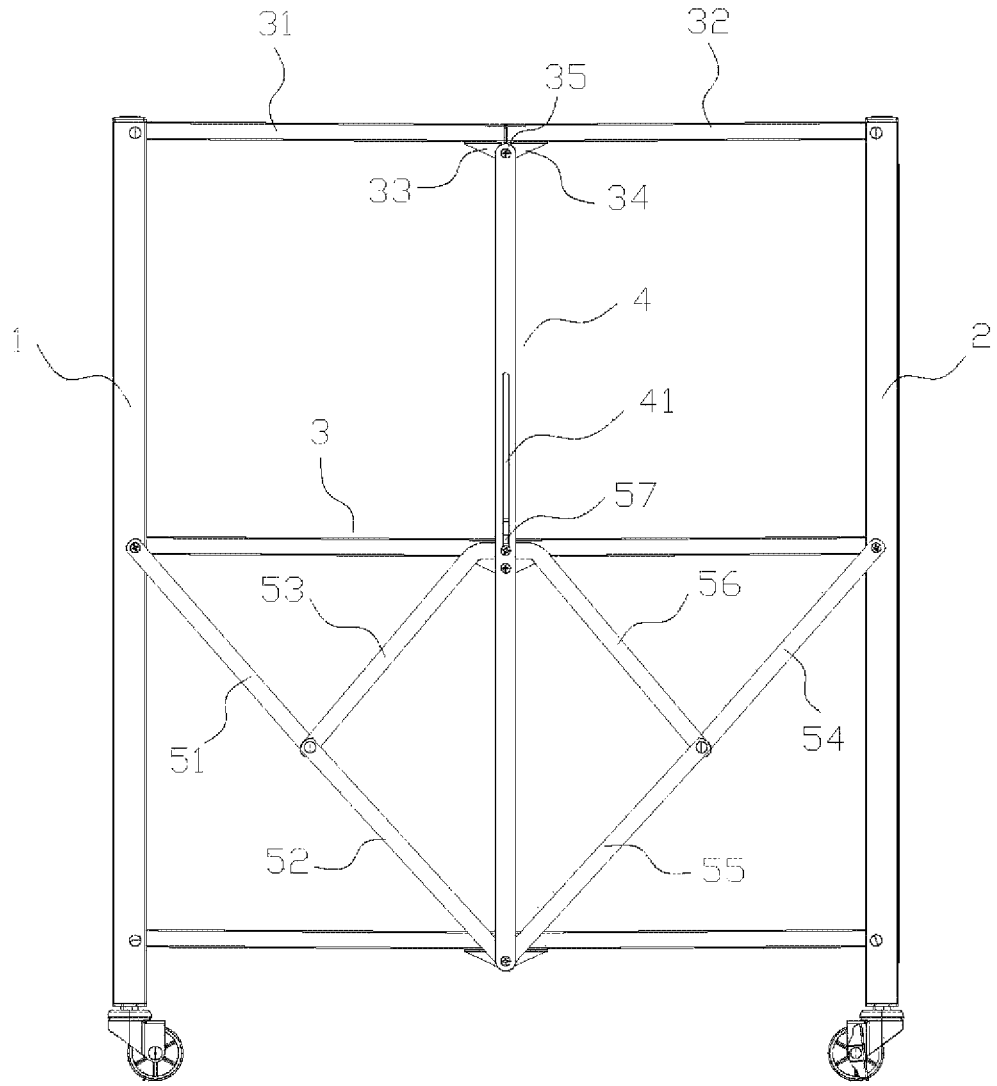
FIG. 3 is a rear diagram of a three-layer diamond-shaped folding rack according to the preferred embodiment 1 of the present disclosure.
Figure 4:
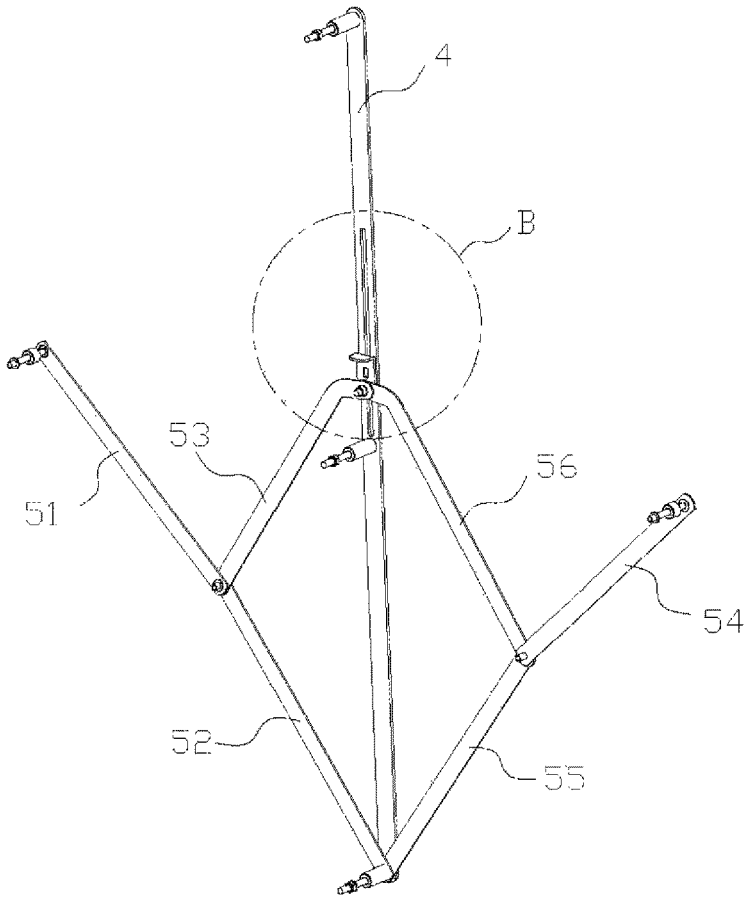
FIG. 4 is a schematic structural diagram of a locking mechanism according to the preferred embodiment of the present disclosure.
Figure 5:
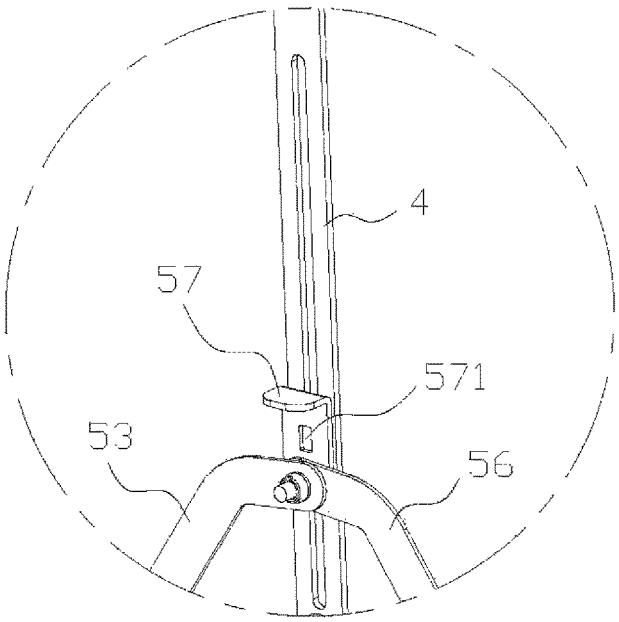
FIG. 5 is a schematic diagram of an enlarged structure of area B in FIG. 4.
Figure 6:
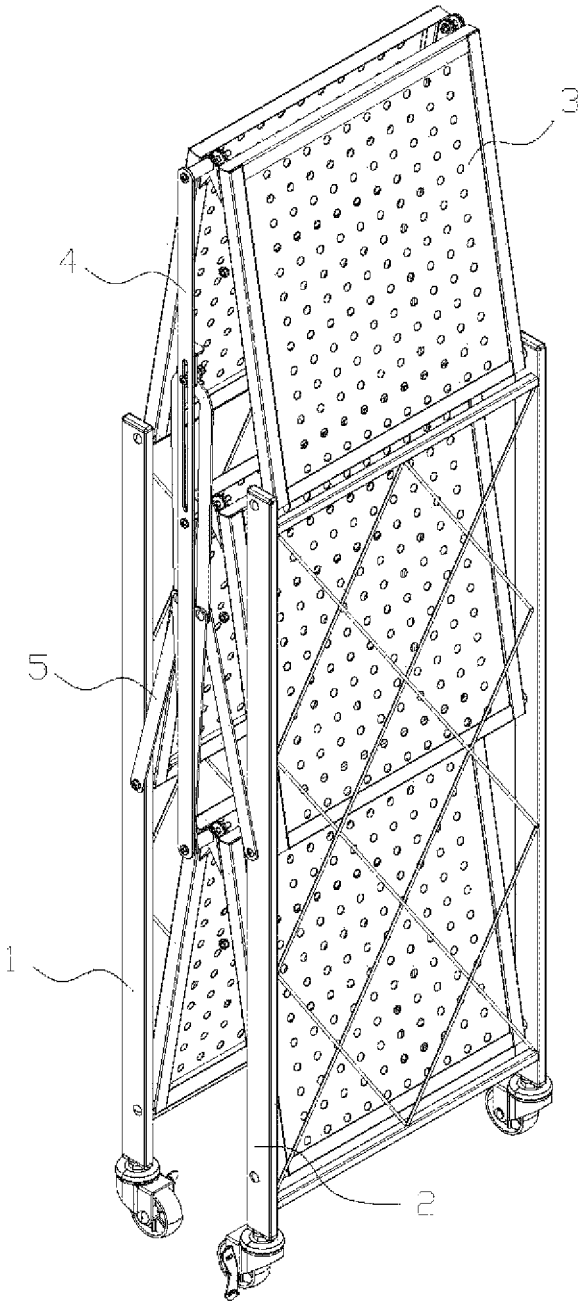
FIG. 6 is a schematic diagram of the folded state of a three-layer diamond-shaped folding rack according to the preferred embodiment 1 of the present disclosure.

In the figures: 1, left side frame; 2, right side frame; 3, folding layer plate; 31, left layer plate; 32, right layer plate; 33, first connector; 34, second connector; 35, pin: 4, linkage vertical rod; 41, elongated slot; 5, locking mechanism; 51, upper left link, 52, lower left link; 53, left support rod; 54, upper right link, 55, lower right link; 56, right support rod; 57, handle buckle; 571, protruding tongue; 6, inverse layer plate; 7, lock fastener; 71, pinball; 72, locking sheet; 73, U-shaped elastic sheet; 8, roller.

DESCRIPTION OF THE EMBODIMENTS

The present disclosure will be further described hereinafter in conjunction with the drawings and specific implementations. It should be noted that, the embodiments or technical features described hereinafter can be arbitrarily combined to form a new embodiment without any conflict.

Embodiment 1: Three-Layer Diamond-Shaped Folding Rack

As shown in FIGS. 1-6, a diamond-shaped folding rack comprises a left side frame 1, a right side frame 2, a folding layer plate 3, a linkage vertical rod 4, and a locking mechanism 5; wherein the left and right ends of the folding layer plate are axially connected to the left and right side frames; the linkage vertical rod is provided at the folding junction of the folding layer plate, the linkage vertical rod moves up to allow the folding layer plate to fold upward: the linkage vertical rod moves down to allow the folding layer plate to unfold downward and horizontally; the locking mechanism comprises a upper left link 51, a lower left link 52, a left support rod 53, an upper right link 54, a lower right link 55, and a right support rod 56; the left support rod, the lower left link, the lower right link, and the right support rod are connected end to end to form a diamond-shaped extendable frame; one end of the upper left link is hinged to the left junction of the diamond-shaped extendable frame, and the other end thereof is hinged to the left frame; one end of the upper right link is hinged to the right junction of the diamond-shaped extendable frame, and the other end thereof is hinged to the right frame; the linkage vertical rod is provided with an elongated slot 41, the upper junction of the diamond-shaped extendable frame slides up and down on the linkage vertical rod along the length of the elongated slot, and the lower junction of the diamond-shaped extendable position is positioned at the bottom of the linkage vertical rod; and when the diamond-shaped extendable frame is pressed down, the left support rod and the right support rod control the upper left link, the lower left link, the upper right link and the lower right link to move to a fold position to lock the folding rack.

The folding rack adopts the structural cooperation of the linkage vertical rod and the locking mechanism, which greatly improves the support strength and effectively realizes the anti-falling effect. The locking stability is strong, and the linkage lock mechanism is folded inward or unfolded outward while the linkage vertical rod moves up or down, so that the multi-layer folding layer plates folded inward or unfolded outward synchronously, it is convenient to operate, and the operation is smooth and stable.

In the present application, the diamond-shaped extendable frame is pressed down to fully unfold the locking mechanism outward. At this time, the left support rod straightens the upper left link and the lower left link, so that the left frame, the bottom folding layer plate and the connecting line between the upper left link and the lower left link encircle a stable triangle structure; synchronously, the right support rod straightens the upper right link and the lower right link, so that the right frame, the bottom folding layer plate and the connecting line between the upper right link and the lower right link encircle a stable triangle structure, which completely locks the entire folding rack. In addition, there are load-bearing objects on the rack to achieve the purpose of locking. Within a certain load-bearing range, the greater the weight of the load-bearing object, the better the locking effect. As a further preferred solution, the upper junction of the diamond-shaped extendable frame is provided with a handle buckle 57, the side of the handle buckle is provided with a protruding tongue 571, and the protruding tongue slides up and down along the length of the elongated slot on the linkage vertical rod. The design of the protruding tongue is used to limit the movement track of the handle buckle and prevent the handle buckle from rotating. The design of the handle buckle makes it convenient for users to lift the diamond-shaped extendable frame, so that the diamond-shaped extendable frame is retracted synchronously. In addition, it also prevents hands from being pinched during the retracting process of the diamond-shaped extendable frame with a humanized design.

As a further preferred solution, the folding layer plate 3 comprises a left layer plate 31 and a right layer plate 32. A first connector 33 is disposed on one side of the left layer plate 31 opposite to the right layer plate 32. A second connector 34 is disposed on one side of the right layer plate 32 opposite to the left layer plate 31. The first connector 33 matches the second connector 34. The first connector and the second connector are connected by a pin 35; and when the folding layer plate is unfolded, the first connector abuts on the second connector, so that the left layer plate and the right layer plate are in a horizontal position. The design of the first connector and the second connector makes the connection of the left layer plate and the right layer plate more stable when unfolded. The linkage vertical rod is installed at the folding junction of the folding layer plate through the pin.

As a further preferred solution, the bottom of the left side frame and the bottom of the right side frame are provided with a roller 8. The design of the roller is convenient to move the rack and enhance the function of the rack.

Embodiment 2: Four-Layer Diamond-Shaped Folding Rack

Figure 7:
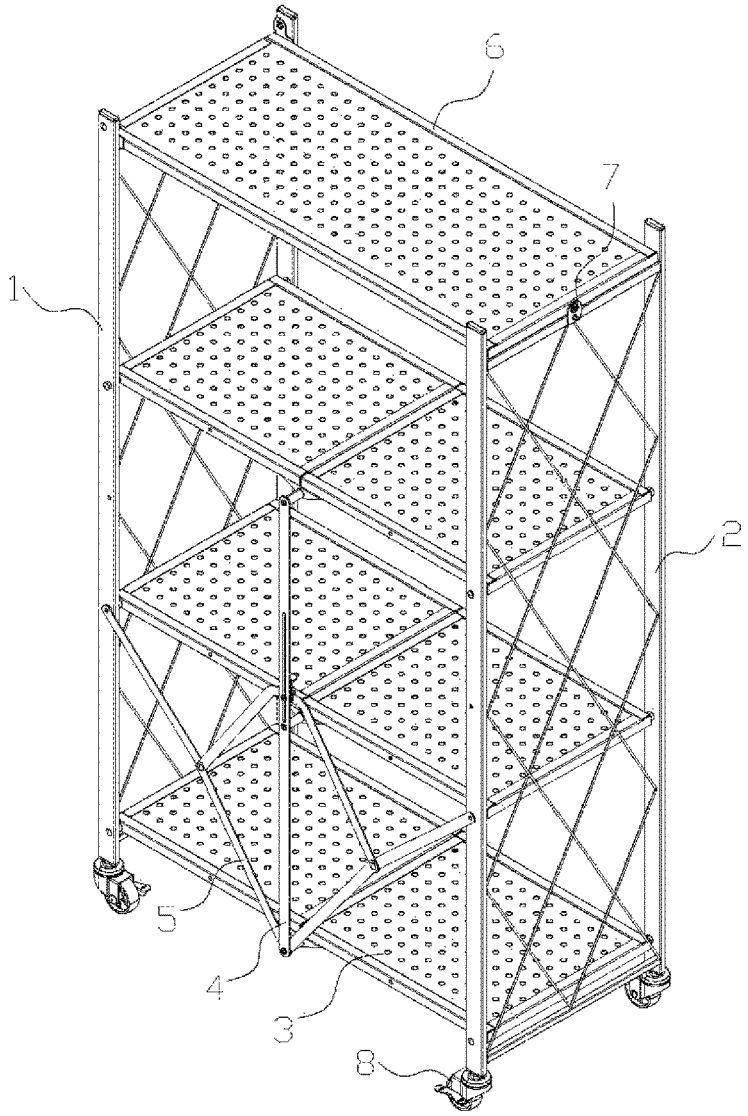
FIG. 7 is a schematic structural diagram of a four-layer diamond-shaped folding rack according to the preferred embodiment 2 of the present disclosure
Figure 8:
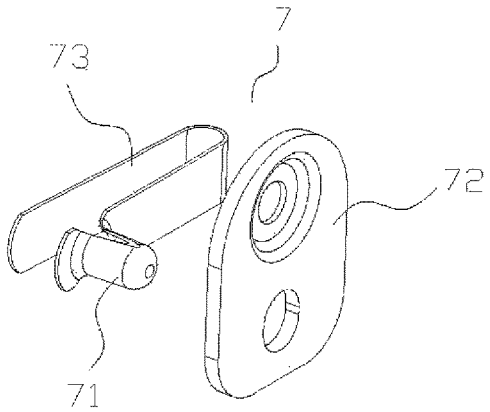
FIG. 8 is a schematic structural diagram of a lock fastener according to the preferred embodiment of the present disclosure.
Figure 9:
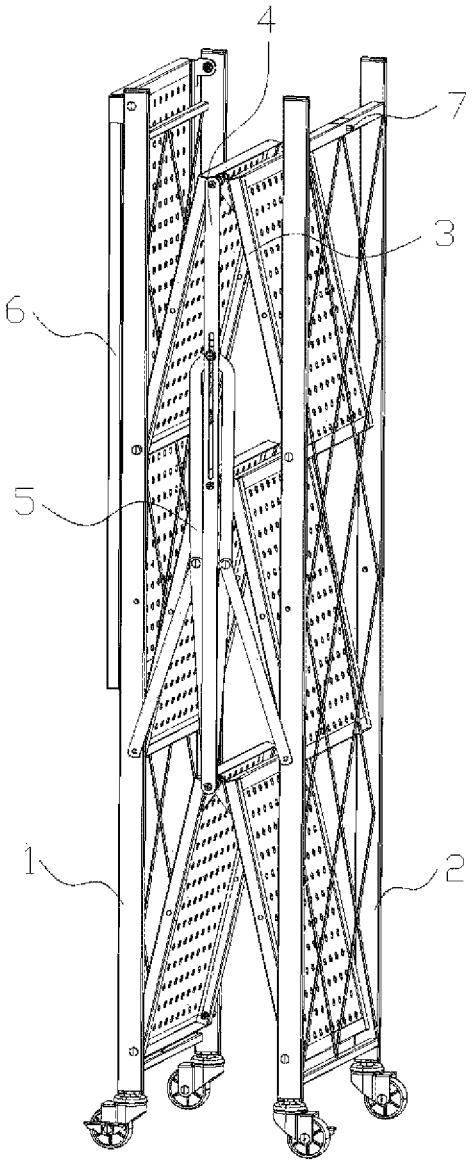
FIG. 9 is a schematic diagram of the folded state of a four-layer diamond-shaped folding rack according to the preferred embodiment 2 of the present disclosure.
Figure 10:
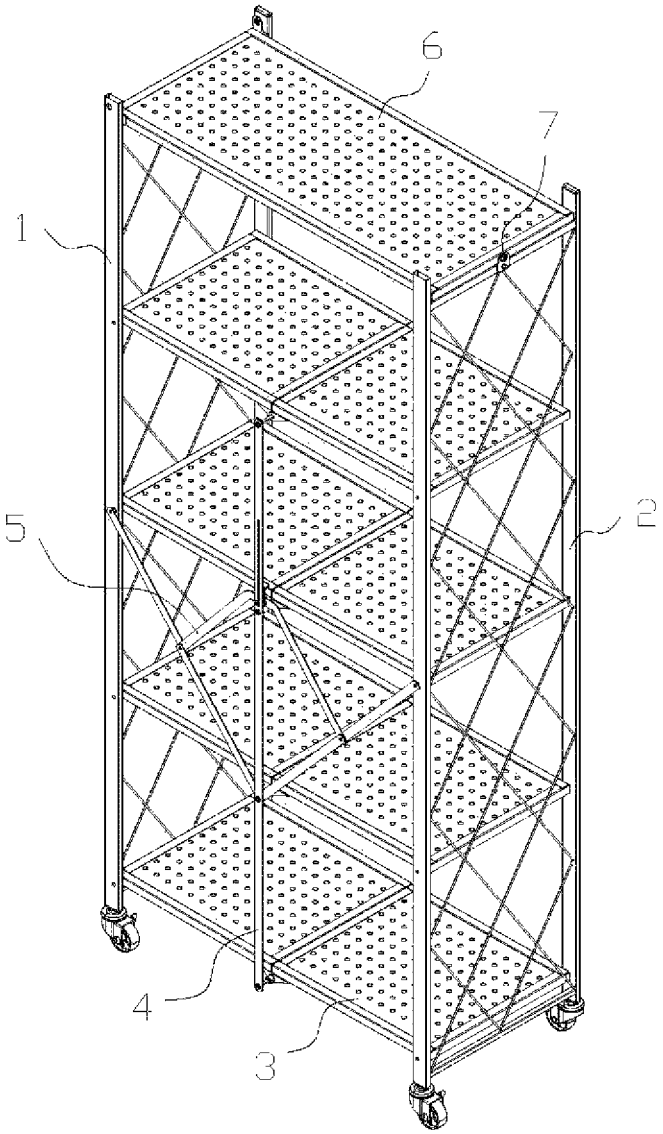
FIG. 10 is a schematic structural diagram of a five-layer diamond-shaped folding rack according to the preferred embodiment 3 of the present disclosure.
Figure 11:
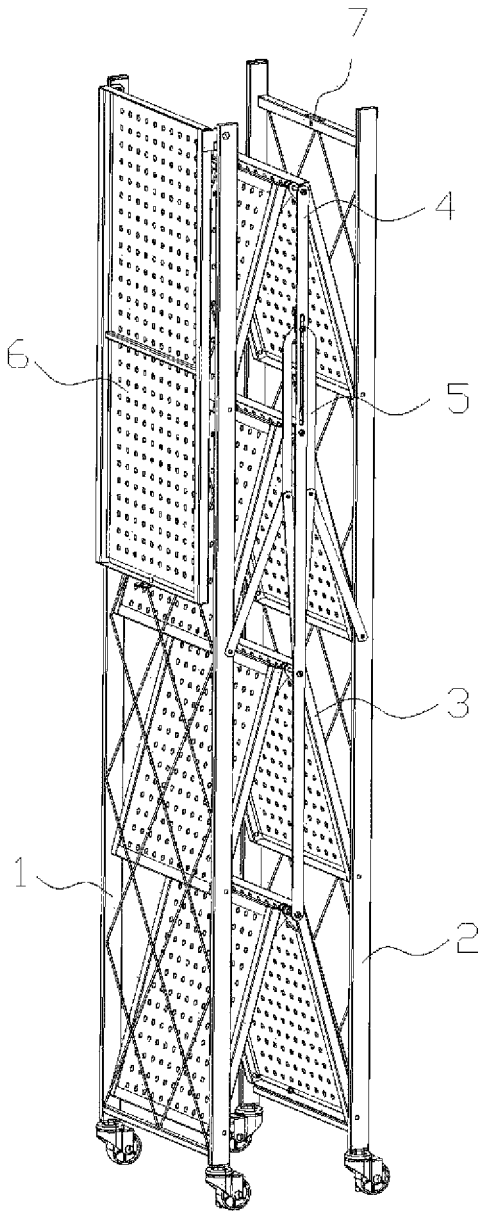
FIG. 11 is a schematic diagram of the folded state of a five-layer diamond-shaped folding rack according to the preferred embodiment 3 of the present disclosure.

As shown in FIGS. 1-9, compared with the diamond-shaped folding rack of embodiment 1, the diamond-shaped folding rack of embodiment 2 further comprises an inverse layer plate 6 provided on the top of the left side frame and the top of the right side frame. As shown in FIGS. 7-9, the overall design of the inverse layer plate improves the rigidity of the four-layer diamond-shaped folding rack on the one hand, and on the other hand, increases the storage space and improves the utilization rate.

As a further preferred solution, one side of the inverse layer plate is hinged on the left side frame, and the other side thereof is fixed on the right side frame by a lock fastener 7. Specifically, the lock fastener comprises a pinball 71 provided on the right side frame and a locking sheet 72 provided on one side of the inverse layer plate, a U-shaped elastic sheet 73 is connected to the pinball, the locking sheet is provided with an opening, and the pinball extends into the opening of the locking sheet to fix the inverse layer plate on the top of the right side frame. The design of the lock fastener locks the position of the inverse layer plate on the folding rack to prevent the inverse layer plate from moving. In addition, the unlocking action of the lock fastener is simple. The U-shaped elastic sheet is pressed to be shrunk, and the pinball is pressed to exit the opening of the locking sheet to unlock the lock fastener. Similarly, the locking action is also very simple. The structure is simple to disassemble and assemble, and can achieve rapid disassembly and assembly.

Embodiment 3: Five-Layer Diamond-Shaped Folding Rack

As shown in FIGS. 1-11, compared with the diamond-shaped folding rack of Embodiment 1, the diamond-shaped folding rack of Embodiment 3 has two differences. The first difference is that the folding layer plate has five layers. The matching structure of the linkage vertical rod and the locking mechanism is installed on a fourth layer of the folding layer plate counting from the bottom. The second difference is that it further comprises an inverse layer plate 6 provided on the top of the left side frame and the right side frame.

In the embodiments 1-3, the upper left link, the lower left link, the upper right link, and the lower right link in the diamond-shaped extendable frame are connected end to end, the folding layer plate is movably connected with the left and right side frames, the linkage vertical rod is connected with the folding layer plate, and the inverse layer plate is connected with the side frame, which are all realized by a pin to realize the movable connection, so as to realize the folding reception and unfolding storage functions of the rack.

The above embodiments are only preferred embodiments of the present disclosure, and cannot be used to limit the scope of protection of the present disclosure. Any insubstantial changes and substitutions made by those skilled in the art on the basis of the present disclosure belong to the scope of protection claimed by the present disclosure.

What is claimed is:

1. A diamond-shaped folding rack, comprising a left side frame, a right side frame, a folding layer plate, a linkage vertical rod, and a locking mechanism: wherein the left and right ends of the folding layer plate are axially connected to the left and right side frames; the linkage vertical rod is provided at a folding junction of the folding layer plate, the linkage vertical rod moves up to allow the folding layer plate to fold upward; the linkage vertical rod moves down to allow the folding layer plate to unfold downward and horizontally; the locking mechanism comprises a upper left link, a lower left link, a left support rod, an upper right link, a lower right link, and a right support rod; the left support rod, the lower left link, the lower right link, and the right support rod are connected end to end to form a diamond-shaped extendable frame; one end of the upper left link is hinged to left junction of the diamond-shaped extendable frame, and the other end thereof is hinged to the left frame; one end of the upper right link is hinged to a right junction of the diamond-shaped extendable frame, and the other end thereof is hinged to the right frame; the linkage vertical rod is provided with an elongated slot, an upper junction of the diamond-shaped extendable frame slides up and down on the linkage vertical rod along the length of the elongated slot, and a lower junction of the diamond-shaped extendable frame is positioned at the bottom of the linkage vertical rod; and when the diamond-shaped extendable frame is pressed down, the left support rod and the right support rod control the upper left link, the lower left link, the upper right link and the lower right link to move to a fold position to lock the folding rack.

2. The diamond-shaped folding rack according to claim 1, wherein the upper junction of the diamond-shaped extendable frame is provided with a handle buckle, the side of the handle buckle is provided with a protruding tongue, and the protruding tongue slides up and down along the length of the elongated slot on the linkage vertical rod.

3. The diamond-shaped folding rack according to claim 1, wherein the folding layer plate comprises a left layer plate and a right layer plate; a first connector is disposed on one side of the left layer plate opposite to the right layer plate; a second connector is disposed on one side of the right layer plate opposite to the left layer plate; the first connector matches the second connector; the first connector and the second connector are connected by a pin; and when the folding layer plate is unfolded, the first connector abuts on the second connector, so that the left layer plate and the right layer plate are in a horizontal position.

4. The diamond-shaped folding rack according to claim 3, wherein the linkage vertical rod is installed at the folding junction of the folding layer plate through the pin.

5. The diamond-shaped folding rack according to claim 1, wherein the top of the left side frame and the top of the right side frame are provided with an inverse layer plate.

6. The diamond-shaped folding rack according to claim 5, wherein one side of the inverse layer plate is hinged on the left side frame, and the other side thereof is fixed on the right side frame by a lock fastener.

7. The diamond-shaped folding rack according to claim 6, wherein the lock fastener comprises a pinball provided on the right side frame and a locking sheet provided on one side of the inverse layer plate, the locking sheet is provided with an opening, and the pinball extends into the opening of the locking sheet to fix the inverse layer plate on the top of the right side frame.

8. The diamond-shaped folding rack according to claim 7, wherein a U-shaped elastic sheet is connected to the pinball.

9. The diamond-shaped folding rack according to claim 1, wherein the bottom of the left side frame and the bottom of the right side frame are provided with more than one roller.

* * * * *